US005725133A

United States Patent [19]

Iaia

[11] Patent Number: 5,725,133

[45] Date of Patent: Mar. 10, 1998

[54] DOSE CONTROL DISPENSER

[75] Inventor: Mark John Iaia, Valley Cottage, N.Y.

[73] Assignee: Chesebrough-Pond's USA Co., Division of Conopco, Inc., Greenwich, Conn.

[21] Appl. No.: 593,315

[22] Filed: Jan. 31, 1996

[51] Int. Cl.[6] ..... B67D 5/42

[52] U.S. Cl. ..... 222/390; 222/391; 401/175

[58] Field of Search ..... 222/390, 391, 222/386; 401/172, 175

[56] References Cited

U.S. PATENT DOCUMENTS

| | | | |
|---|---|---|---|
| D. 331,534 | 12/1992 | Thompson et al. . | |
| D. 331,639 | 12/1992 | Thompson . | |
| 1,950,324 | 3/1934 | Powers . | |
| 2,080,343 | 5/1937 | Smith . | |
| 2,335,049 | 11/1943 | Finkelstein . | |
| 3,104,031 | 9/1963 | Wagner . | |
| 3,185,345 | 5/1965 | Hunegs | 222/390 X |
| 3,749,871 | 7/1973 | Stoll et al. | 200/156 |
| 4,595,124 | 6/1986 | Duval et al. | 222/390 |
| 4,753,373 | 6/1988 | Seager | 222/390 |
| 4,865,231 | 9/1989 | Wiercinski | 222/390 |
| 5,000,356 | 3/1991 | Johnson et al. | 222/391 |
| 5,007,755 | 4/1991 | Thompson et al. | 401/175 |
| 5,025,960 | 6/1991 | Seager | 222/390 |
| 5,111,972 | 5/1992 | Sakurai et al. | 222/390 |
| 5,540,361 | 7/1996 | Fattori | 222/390 |
| 5,573,341 | 11/1996 | Iaia | 401/175 X |

FOREIGN PATENT DOCUMENTS

| | | | |
|---|---|---|---|
| 40 19 582 | 1/1992 | Germany | 222/390 |
| 403240678 A | 2/1990 | Japan . | |
| 261014 | 10/1949 | Switzerland . | |
| 281384 | 6/1952 | Switzerland . | |

*Primary Examiner*—Kenneth Bomberg
*Attorney, Agent, or Firm*—Milton L. Honig

[57] ABSTRACT

A dispenser is provided that includes a container for storing a dispensable chemical product such as an underarm composition, an elevator mounted for axial movement within the container, a rotatable shaft attached to the elevator, a compartment within the container below the elevator and mechanisms for axially advancing and for reciprocating the elevator within the container. Each mechanism is actuated through a depressible button protruding from the housing. A flexible plastic band serving as a biasing spring is unitarily molded with the button as a plastic insert. The advancement mechanism includes a ratchet wheel with a plurality of teeth circumferentially surrounding the wheel and a pawl, attached to the plastic insert, for moving the teeth of the ratchet wheel. The reciprocating mechanism includes an angled ramp attached to an underside of the button. The ramp is positioned below the ratchet wheel for applying variable pressure thereto so as to raise the elevator but also to allow a slight retraction of the elevator after it has been advanced.

14 Claims, 3 Drawing Sheets

DOSE CONTROL DISPENSER

BACKGROUND OF THE INVENTION

1. Field of the Invention

The invention concerns a dispenser for solid or semi-solid compositions, particularly underarm cosmetics, which are delivered in a metered quantity from a chamber by rotation of a screwdrive elevating a piston contacting the compositions.

2. The Related Art

Underarm cosmetics such as antiperspirants and deodorants traditionally have been delivered in three distinct formats. Application has been either through aerosol sprays, roll-on ball applicators or propel-repel piston operated sticks. Commercially most popular has been the stick variety. More recently, a fourth underarm product format has entered the marketplace, namely semi-solids. Packaging for the semi-solids has proved quite challenging.

An early entry into the semi-solid product form was Arrid® Extra Dry Glide-On distributed by the Carter-Wallace Company. Packaging of this product is similar to that utilized for traditional sticks. An oval container with a knurled screw propel-repel mechanism is employed to control a screw-type piston. The new aspect is a plastic dome around the upper end of the container, with a series of apertures in the plastic dome for exit of the semi-solid product.

More recently the Gillette® Series products entered the marketplace. Besides a transparent package and clear product, Gillette® innovated with refinement of the product dispensing apertures. U.S. Pat. No. 5,007,755 (Thompson), assigned to the Gillette Company, describes a domed application surface structure having an array of dispensing ports located at an outlet end of respective elongated distribution passages. These passages are further defined by an interconnected array of elongated divider webs shaped to provide each of the passages with a flared entrance port and a relieved dispensing port region at the application surface. Metered quantities of gel cosmetic material are reported achievable as a result of this array of flared entrance ports, interconnected divider webs, distribution passages and dispensing ports. See also the related design cases: U.S. Pat. No. Des. 331,534 and U.S. Pat. No. Des. 331,639.

On the heels of these developments, the Procter & Gamble Company launched its version of a semi-solid underarm product known as Secret® Ultra Dry. U.S. Pat. No. 5,000,356 (Johnson et al.) describes the Secret® Ultra Dry package as a swivel-up type dispensing container using a feed screw to drive an elevator which impels the cream product in a unidirectional manner. The drive of the feed screw is superimposed with reciprocatory motion caused by internal cams which retract the elevator. By intermittently retracting the elevator a suitable distance, discrete amounts of the product are dispensed for each cycle. Residual pressure on the product is thereby also relieved which prevents it from weeping onto the applicator surface of the dispenser.

Related technology is disclosed in U.S. Pat. No. 4,865,231 (Wiercinski). This swivel-up type dispensing package includes a button adapted to be depressed by the user in a direction which is generally transverse to the axis of the body of the dispensing package. Transverse movement of the button is converted to rotary input to either a feed screw or nut to cause one to rotate relative to the other and thereby move an elevator for the product. The button has an integral pawl which during transverse movement engages ratchet teeth fixed to a wheel mounted perpendicularly to the axis of the body, causing the wheel to rotate through an arc subtended by driven teeth.

Japanese Patent Publication 3-240678 (A) reports a liquid discharging device that includes a mechanism to quantify discharge by using a click or collision sound at a time when ratchet teeth are mutually brought near an elastic member.

U.S. Pat. No. 5,111,972 (Sakurai et al.) describes a multi-compartment dispenser for delivering a plurality of different creamy substances. The dispenser includes a tubular case with two chambers containing the creamy substances, a tubular member disposed within each chamber for axial movement, a hollow cylinder rotatably fitted over each tubular member and having longitudinal teeth on its outer surface, an extrusion plunger fitted into each chamber for axial movement which includes a plate member, a tubular boss projecting downwardly from the plate member, and an operating member capable of simultaneously rotating the two hollow cylinders. The operating member is moved to turn the hollow cylinders by a predetermined angle so that the extrusion plungers are raised simultaneously a predetermined distance thereby extruding the creamy substances.

From the foregoing description of the related art, it is evident there have been some significant advances in the packaging of semi-solid products. Yet, a number of further challenges remain. Some of the aforementioned packaging involves complicated mechanisms that are relatively expensive to manufacture. Certain of the packages require two-handed operation which renders them somewhat inconvenient during the dispensing operation along the underarms. Others of the aforementioned devices do not provide the user with a proper indication of the amount of product metered.

Many of these problems have been addressed with a dispenser described in co-pending U.S. patent application Ser. No. 08/329,569, filed Oct. 26, 1994, now U.S. Pat. No. 5,573,341. Even this dispenser has not however solved the problem of weeping. Product still remains at the dispenser outlet even after the desired release of material has been completed.

Accordingly, it is an object of the present invention to provide a dispenser for solids or semi-solids that provides a user with finer control in metering doses from the dispenser.

Another object of the present invention is to provide a dispenser for solids or semi-solids that includes a mechanism with an audible click allowing a user to dispense identical dosages repetitively and accurately.

Yet another object of the present invention is to provide a dispenser for solids or semi-solids that does not require two-handed operation during dispensing of product, especially in the underarm area of a human body.

Yet a further object of the present invention is to provide a dispenser for solids or semi-solids that eliminates the problem of weeping onto the applicating surface.

These and other objects of the present invention will become more readily apparent through consideration of the following summary and description.

SUMMARY OF THE INVENTION

A dispenser is provided that includes:

a container for storing a dispensable chemical product, the container having a dispensing end and a closed end which are opposite one another and located along a longitudinal axis traversing a length of the container;

an elevator having a cross-section congruent to an internal cross-section of the container and mounted for axial movement within the container;

a rotatable shaft attached to the elevator for imparting upward movement thereto, the shaft being parallel to the longitudinal axis of the container;

a compartment located below the elevator at the closed end of the container;

a mechanism for axially advancing the elevator within the container;

a mechanism for axially reciprocating the elevator, the mechanisms for axially advancing and reciprocating the elevator being received within the compartment; and a button mounted within the compartment and adapted to be manually depressed in a direction generally transverse to the longitudinal axis of the container and capable of activating both the mechanism for axially advancing and axially reciprocating the elevator.

In a preferred embodiment, the mechanism for axially advancing the elevator will include:

a ratchet wheel with a plurality of teeth circumferentially surrounding the wheel, the wheel being orthogonally oriented and attached to an end of the shaft; and a pawl engageable with teeth of the ratchet wheel, the pawl being connected to the button.

The mechanism for reciprocally advancing the elevator is characterized by a ramp whose upper surface is slidably engageable against a surface along an underside of the ratchet wheel. The ramp is attached to the button and projects inwardly therefrom. Directly above the ratchet wheel surrounding the shaft is a spring. The spring is seated in a plane perpendicular to the longitudinal axis of the container and downwardly presses the ratchet wheel against the upper surface of the ramp. The upper surface of this ramp is oriented at an acute angle to the longitudinal axis of the container but defines an obtuse angle with a wall of the button to which it is attached.

The button is framed in a window in an outer wall of the housing. A flexible plastic band unitarily molded together with the button forms a plastic insert. The band with left and right wings flanking the button serves as a spring for the button. Directly opposite the button and formed within the band is a recess engageable with an inwardly projecting rib of the compartment. Rib and recess mate to anchor the plastic insert.

BRIEF DESCRIPTION OF THE DRAWING

The above features, advantages and objects of the present invention will more fully be appreciated through the following detailed discussion, reference being made to the drawings consisting of.

DETAILED DESCRIPTION OF THE INVENTION

Figure 1:
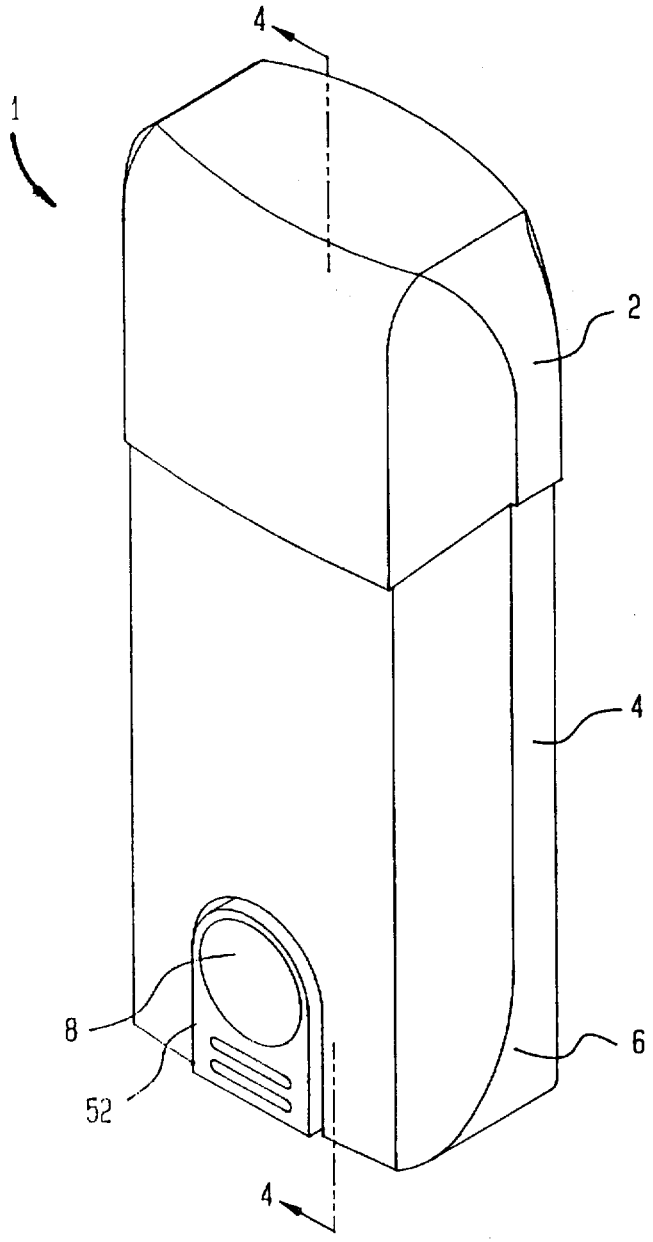
FIG. 1 which is a front perspective view of the dispenser according to the present invention.
Figure 2:
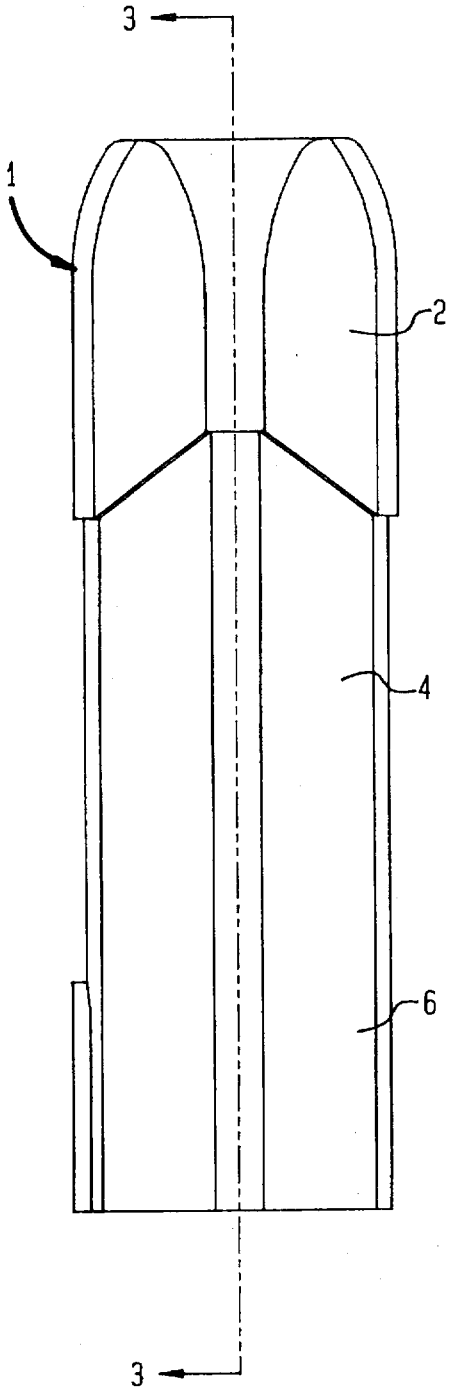
FIG. 2 which is a side elevational view of the dispenser as shown in FIG. 1.

According to the present invention, the most preferred embodiment is dispenser 1 whose external views are shown in FIGS. 1 and 2. Dispenser 1 includes a cap 2 to prevent dryout, a container 4 for storage of a dispensable chemical product, a compartment 6 within the container for housing a mechanism to cause dispensing of the chemical product and a button 8 which a user presses to activate the dispensing mechanism.

Figure 3:
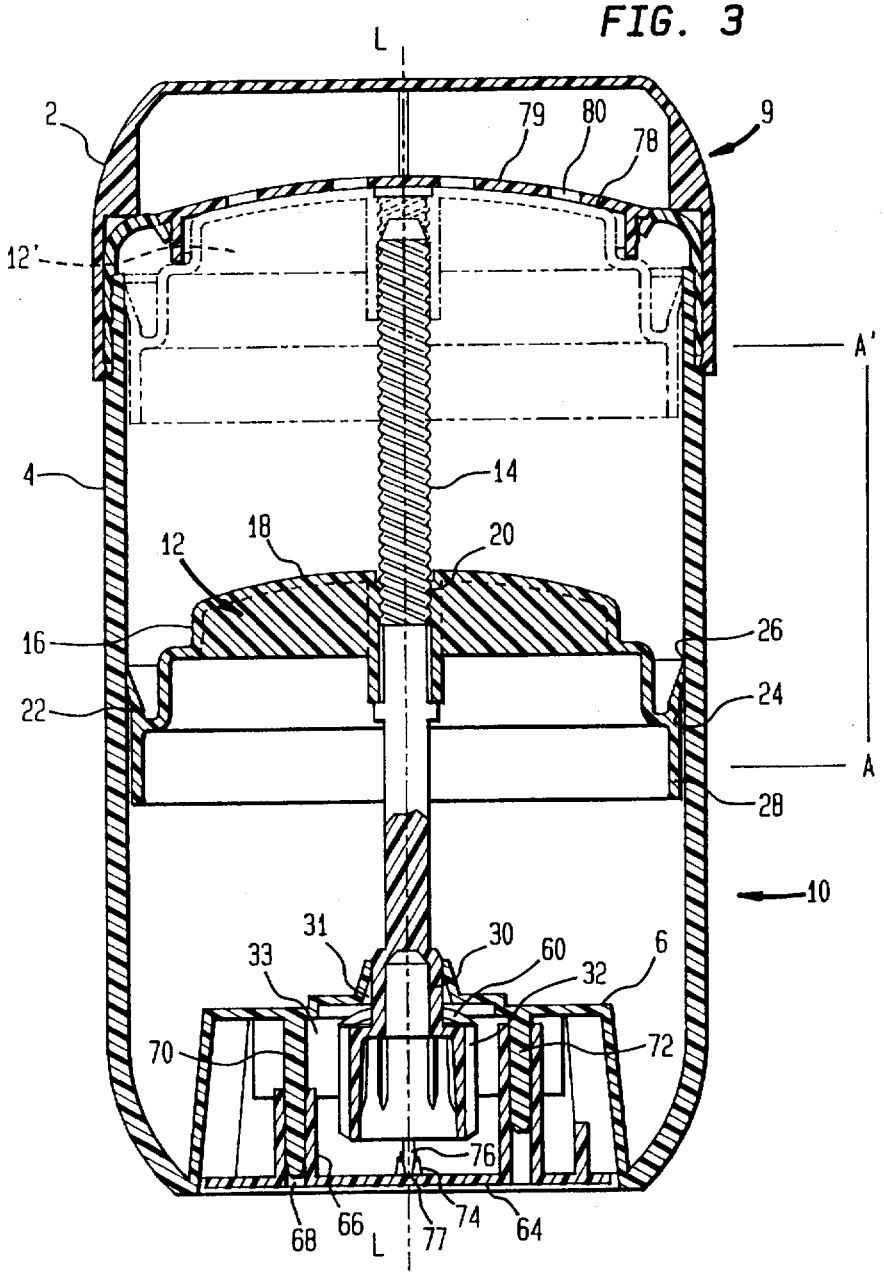
FIG. 3 which is a cross-sectional view of the dispenser taken along lines 3—3 of FIG. 2.
Figure 4:
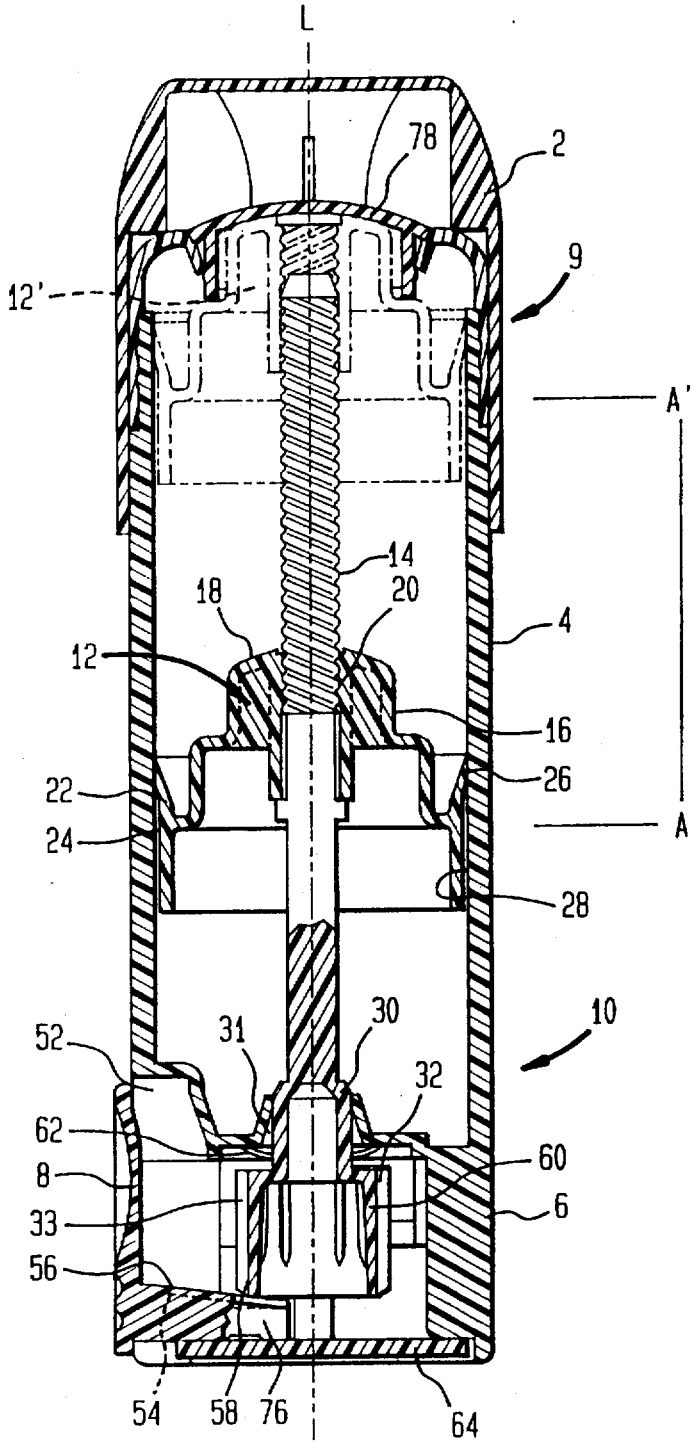
FIG. 4 which is a cross-sectional view of the dispenser taken along line 4—4 of FIG. 1.

FIGS. 3 and 4 are cross-sectional views of the dispenser illustrating various functional elements held within dispenser 1. Container 4 is formed with a dispensing end 9 and a closed end 10 opposite one another and located along a longitudinal axis L traversing a length of the container. An elevator 12 is mounted for axial movement within container 4. The elevator 12 has a cross-section congruent to an internal cross-section of the container. Upward or downward movement of elevator 12 is directed by the rotation of a rotatable shaft 14, the shaft being parallel to longitudinal axis L of the container.

Elevator 12 includes a crown 16, having an upper surface 18 in contact with the dispensable chemical product. At the center of the crown is a round female threaded aperture 20 through which rotatable shaft 14 extends and can engage for threadable movement. Crown 16 is surrounded by a skirt 22 formed of a flexible plastic. Skirt 22 is concave in shape. As a result, skirt 22 sealingly contacts an inner wall 24 of container 4 only along an upper and a lower margin 26, 28 of the skirt.

When all the chemical product contained within the container has been spent, elevator 12 will have moved from position A to position A'. In FIGS. 3 and 4, the elevator 12' is shown in phantom to illustrate the fully dispensed position of A'. As seen from the drawings, the most preferred geometry for the dispenser, and therefore of necessity for the container, cap, compartment and elevator with crown and skirt, is an oval shape.

Figure 5:
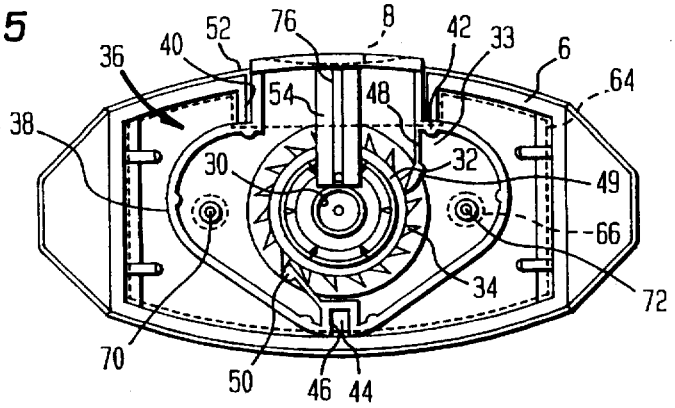
FIG. 5 which is a bottom plan view of the dispenser according to FIG. 1.

Rotatable shaft 14 at its lower terminus ends in a coupling element 30 held within compartment 6. An aperture 31 within compartment 6 opens to permit coupling element 30 to pass therethrough into an interior area 33 of the compartment. A ratchet wheel 32 is rigidly attached to coupling element 30. This aspect of the invention is best seen in FIG. 5. Ratchet wheel 32 is provided with a plurality of teeth 34 circumferentially surrounding the wheel, the latter being orthogonally oriented to the shaft.

A unitarily molded plastic insert 36 is supported within interior area 33 of the compartment. Plastic insert 36 consists of button 8 and a flexible circular band 38 whose ends 40, 42 terminate on respective left and right flanks of button 8. A recess 44 is formed within flexible band 38 directly opposite the button. Recess 44 mates with rib 46 formed as an inward projection on an interior surface of compartment 6. A pawl 48, formed unitarily with plastic insert 36 protrudes inwardly. A free end 49 of the pawl is positioned to engage teeth of the ratchet wheel. A second pawl 50, also unitarily formed with the plastic insert 36, protrudes adjacent recess 44 towards the ratchet wheel for additional engagement with its teeth.

Button 8 is aligned within a window 52 of the housing. Unitarily molded onto the button is an inwardly projecting ramp 54. Upper surface 56 is positioned below ratchet wheel 32 and contacts a bevelled lower surface 58 thereof. Tensioned against an upper surface 60 of the ratchet wheel is a spring 62.

Plastic insert 36 is further held within the compartment by a bottom plate 64. Molded unitarily onto the plate are a pair of upwardly projecting posts 66, each with a hollow interior 68. A pair of rods 70, 72 of different lengths thrust downward from a ceiling of the compartment. The rods flank the ratchet wheel on opposite sides thereof. Rods 70, 72 snugly mate within the hollows 68 of each post 66.

Additional support to plastic insert 36 is provided by a set of elongate parallel ridges 74 projecting upwards from an interior surface of plate 64. An elongate blade 76 is formed as a downwardly oriented element projecting from an undersurface of ramp 54. Blade 76 moves slidingly in channel 77 created between the parallel ridges 74 which serve as a guide mechanism.

A cover 78 fits over container 4 at the dispensing end 9. Top surface 79 of cover 78 is formed with four slanted slots 80 which permit passage of the dispensable chemical product from the container onto an application surface (e.g. a human underarm).

Dispenser 1 is operated by a user pressing button 8. Pressure on the button forces pawl 48 inward which causes ratchet wheel 32 to rotate one tooth distance. A clicking sound results from pawl 50 being moved over a tooth as the ratchet wheel turns. Pawl 50 additionally functions to prevent any significant counter rotation of the ratchet wheel. Concurrent with rotation of the ratchet wheel, shaft 14 rotates resulting in elevator 12 moving upward by interaction of threads on the shaft advancing within the female threaded aperture 20 of crown 16. Chemical product is thereby expressed through slots 80 of cover 78. Upon release of pressure against the button, band 38 acting as a spring returns the button/pawl to its original unactivated position. During the return, pawl 48 also may emit a clicking sound as it passes over a tooth of the ratchet wheel.

Simultaneous with forward activation of the ratchet wheel, upper surface 56 of ramp 54 angularly pushes upward against undersurface 58 of the ratchet wheel. The angled relationship of ramp 54 to the ratchet wheel causes the latter to force elevator 12 and rotatable shaft 14 upwards an additional distance forcing more chemical product to be expressed through the slots. Release of the button to its original position permits the ratchet wheel to partially rotate counter to its original pawl induced motion. Pressure from the ramp will also be steadily released. As a result, the elevator will retract slightly through the distance which it advanced on the forward button stroke. Thus, pawl 48 drives axial advancement while platform 54 (in conjunction with spring 60) reciprocates the elevator. In this way advancement and reciprocating mechanisms cooperate, the elevator being reciprocated one cycle for each predetermined increment of forward axial advancement.

The foregoing description illustrates only a selected embodiment of the present invention. In light thereof, various modifications will be suggested to one skilled in the art, all of which are within the spirit and purview of this invention.

What is claimed is:

1. A dispenser comprising:

a container for storing a dispensable chemical product, the container having a dispensing end and a closed end which are opposite one another and located along a longitudinal axis traversing a length of the container;

an elevator having a cross-section congruent to an internal cross-section of the container and mounted for axial movement within the container;

a rotatable shaft attached to the elevator for imparting upward movement thereto, the shaft being parallel to the longitudinal axis of the container;

a compartment located below the elevator at the closed end of the container;

a means for axially advancing the elevator within the container comprising a ratchet wheel with a plurality of teeth circumferentially surrounding the wheel;

a means for axially reciprocating the elevator, the means for axially advancing and reciprocating the elevator being received within the compartment; and a button mounted within the compartment and adapted to be manually depressed in a direction generally transverse to the longitudinal axis of the container and capable of activating both the means for axially advancing and axially reciprocating the elevator, the means for axially reciprocating comprising a ramp attached to the button projecting inwardly and having an upper surface, the upper surface being slidably positioned below the ratchet wheel and contacting a lower surface thereof, and a spring means above the ratchet wheel for pressing the ratchet wheel downward against the ramp.

2. A dispenser according to claim 1, wherein the means for axially advancing the elevator within the container comprises:

the wheel being orthogonally oriented and attached to an end of the shaft; and a pawl engageable with the teeth of the ratchet wheel, the pawl being connected to the button.

3. A dispenser according to claim 1 wherein the container is oval in shape and the elevator includes an oval crown surrounded by an oval skirt, the skirt being formed from a flexible plastic, concave in shape and contacting an inner wall of the container only along an upper and a lower margin of the skirt.

4. A dispenser according to claim 1 wherein the ramp on an underside thereof further comprises an elongate blade oriented downwardly.

5. A dispenser according to claim 1 further comprising a flexible plastic band within the compartment, unitarily molded with the button and having ends terminating on respective left and right flanks of the button.

6. A dispenser according to claim 5 further comprising a recess formed in the plastic band directly opposite the button.

7. A dispenser according to claim 6 further comprising a rib on an inner wall of the compartment facing the button and mating within the recess of the flexible band.

8. A dispenser according to claim 1 further comprising a bottom plate serving as a floor for the compartment.

9. A dispenser according to claim 8 further comprising a pair of posts projecting upwardly from the plate, each post having a hollow interior and being arranged on opposite sides of the ratchet wheel from one another.

10. A dispenser according to claim 9 wherein the compartment on a ceiling thereof further comprises a pair of rods oriented downwardly and arranged to snugly fit within the respective hollows of the upwardly projecting posts of the bottom plate.

11. A dispenser according to claim 8 wherein the bottom plate further comprises a pair of parallel elongate ridges projecting upwardly and spaced from one another to form a channel.

12. A dispenser according to claim 11 wherein, the ramp on an underside thereof having an elongate blade oriented downwardly and the channel slidingly receiving the downwardly oriented blade.

13. A dispenser comprising:

a container for storing a dispensable chemical product, the container having a dispensing end and a closed end which are opposite one another and located along a longitudinal axis traversing a length of the container;

an elevator having a cross-section congruent to an internal cross-section of the container and mounted for axial movement within the container;

a rotatable shaft attached to the elevator for imparting upward movement thereto, the shaft being parallel to the longitudinal axis of the container;

a compartment located below the elevator at the closed end of the container;

a means for axially advancing the elevator within the container;

a means for axially reciprocating the elevator, the means for axially advancing and reciprocating the elevator being received within the compartment;

a button mounted within the compartment and adapted to be manually depressed in a direction generally transverse to the longitudinal axis of the container and capable of activating both the means for axially advancing and axially reciprocating the elevator;

a flexible plastic band within the compartment, unitarily molded with the button and having ends terminating on respective left and right flanks of the button;

a recess formed in the plastic band directly opposite the button; and a rib on an inner wall of the compartment facing the button and mating within the recess of the flexible band.

14. A dispenser comprising:

a container for storing a dispensable chemical product, the container having a dispensing end and a closed end which are opposite one another and located along a longitudinal axis traversing a length of the container;

an elevator having a cross-section congruent to an internal cross-section of the container and mounted for axial movement within the container;

a rotatable shaft attached to the elevator for imparting upward movement thereto, the shaft being parallel to the longitudinal axis of the container;

a compartment located below the elevator at the closed end of the container;

a means for axially advancing the elevator within the container;

a means for axially reciprocating the elevator, the means for axially advancing and reciprocating the elevator being received within the compartment;

a button mounted within the compartment and adapted to be manually depressed in a direction generally transverse to the longitudinal axis of the container and capable of activating both the means for axially advancing and axially reciprocating the elevator;

a bottom plate serving as a floor for the compartment and comprising a pair of parallel elongate ridges projecting upwardly and spaced from one another to form a channel; and wherein the means for axially reciprocating comprises a ramp attached to the button, the ramp on an underside thereof having an elongate blade oriented downwardly and the channel slidingly receiving the downwardly oriented blade.

* * * * *